United States Patent [19]

Singer

[11] 4,307,850

[45] Dec. 29, 1981

[54] STRAND TENSIONING APPARATUS

[76] Inventor: Hans S. Singer, 191 Inglewood, Greenville, S.C. 29615

[21] Appl. No.: 116,572

[22] Filed: Jan. 29, 1980

[51] Int. Cl.[3] ..... B65H 59/24; B65H 59/30

[52] U.S. Cl. ..... 242/19; 242/36; 242/151

[58] Field of Search ..... 242/151, 152, 152.1, 242/149, 147 R, 19, 36, 37 R

[56] References Cited

U.S. PATENT DOCUMENTS

| | | | |
|---|---|---|---|
| 1,313,919 | 8/1919 | Sawtell | 242/151 X |
| 1,618,699 | 2/1927 | Davis | 242/151 |
| 3,096,945 | 7/1963 | Wildi | 242/19 |
| 3,129,902 | 4/1964 | Juillard | 242/149 |
| 4,095,757 | 6/1978 | Singer | 242/151 |
| 4,165,056 | 8/1979 | Singer | 242/151 |

FOREIGN PATENT DOCUMENTS

| | | | |
|---|---|---|---|
| 1300261 | 6/1962 | France | 242/36 |

*Primary Examiner*—Stanley N. Gilreath
*Attorney, Agent, or Firm*—Bailey, Dority & Flint

[57] ABSTRACT

A yarn tensioning device is illustrated employing longitudinally spaced stacks of transverse cylindrical rollers, the lowermost of which open upon a yarn passageway for exerting tension upon the yarn at spaced points along the yarn path which extends longitudinally beneath the rollers, wherein an upwardly extending passageway opens laterally and is defined by an upwardly extending member and an overhanging flange so that the yarn may be conveniently fed under the ends of the lowermost rollers which project into the passageway and then into the yarn passageway and retained therein during tensioning.

2 Claims, 4 Drawing Figures

STRAND TENSIONING APPARATUS

BACKGROUND OF THE INVENTION

This is an improvement relating to the subject matter of U.S. Pat. Nos. 4,095,757, and 4,165,056 the disclosures of which are incorporated herein and made a part hereof by reference. These patents illustrate the use of plural longitudinally spaced stacks of rotatable elements which are contained within a housing opening upon a yarn passageway or channel contained within a hardened yarn channel forming member which is illustrated as a ceramic member. These constructions do not make adequate provision for threading of the yarn into the yarn channel because in the first of the patents the yarn channel is not sufficient to retain the yarn or prevent longitudinal dislocation of the rotatable elements. The other of the patents illustrates an apparatus which must be threaded longitudinally raising each of the rotatable elements which occasions considerable difficulty during threading.

Accordingly, it is an important object of this invention to provide a yarn tension device employing stacks of cylindrical rollers which may be threaded in a single motion through a lateral opening or passageway opening beneath the rollers for facilitating threading while at the same time maintaining the yarn in threaded position beneath the rollers during tensioning.

Another object of the invention is to maintain the roller members especially when there is only one roller in a stack against longitudinal dislocation while maintaining the roller in position against lateral dislocation.

Another object of the invention is to provide a means for readily parting the thread should the yarn path be dislocated because of excessive tensioning while positioning the yarn path so as to make possible raising and lowering respective stacks of rollers for compensating against unusual tension being placed in the yarn.

Another object of the invention is to provide a central raised portion beneath each of the stacks of rollers in a central longitudinal plane so as to present the yarn for engagement by the lowermost of each of the rollers to insure positive tension thereon.

BRIEF DESCRIPTION OF THE INVENTION

It has been found that a lateral passageway may be provided which opens beneath an end portion of rollers arranged in longitudinally spaced stacks within a housing in such a manner that the housing has a depending flange portion which overlaps an upwardly extending portion forming the yarn channel so as to facilitate threading and position the yarn against movement out of the channel as might result from excessive ballooning during tensioning.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring more particularly to the drawings a yarn tension device utilizing cylindrical rollers is illustrated wherein the rollers are carried for rotation in a plurality of spaced longitudinally aligned upright receptacles in a housing, the receptacles opening into a yarn passageway positioning the rollers in rotating engagement with the yarn at spaced positions along the yarn passageway. A lateral passageway A opens beneath the rollers adjacent an end thereof and on one side of the yarn passageway. A depending flange B is carried by the housing and extends over the lateral passageway opposite the rollers. An element C defines the yarn passageway and presents a yarn guiding surface forming a lower portion of the lateral passageway. The element C projects above a lower edge of the flange so that the element guides the yarn for threading into the lateral passageway and retains the yarn therein during yarn tensioning.

Figure 1:
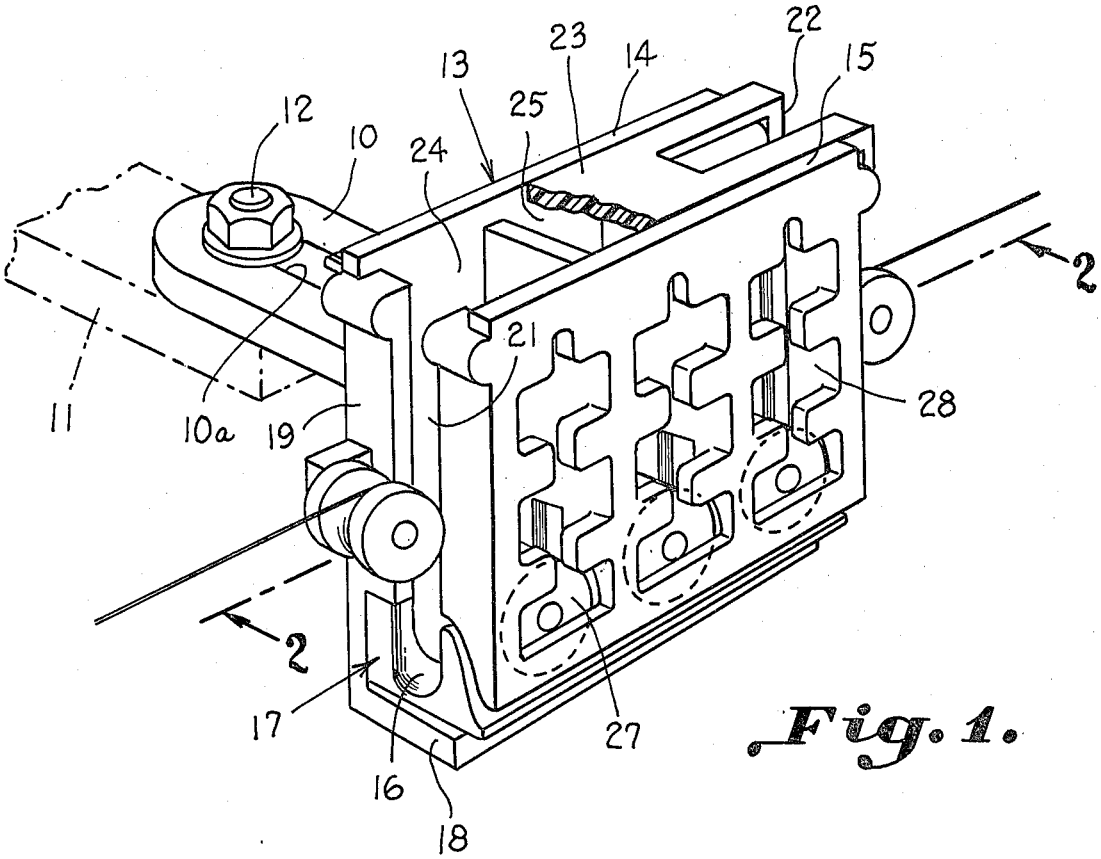
FIG. 1 is a perspective view illustrating a yarn tensioning apparatus constructed in accordance with the present invention illustrating the opening of the lateral passageway hereof beneath the rollers.

FIG. 1 illustrates a suitable bracket 10 for attachment upon the frame or bracket portion 11 of a textile machine and the like which is involved in the yarn tensioning. A suitable fastener 12 such as a nut and bolt is passed through a slot 10*a* in the bracket 10 for adjustably positioning the housing broadly designated at 13 of the yarn tensioning device with respect to the textile machine. The housing 13 has a back wall 14 and a front wall 15 spaced forwardly thereof. A yarn passageway 16 is formed within a suitable yarn tensioning element broadly designated at 17. The yarn tension element is preferably constructed of suitable wear resistant material such as any of the well known ceramics and the like. The sides 15 are bridged by a suitable lower or base member 18 and end walls 19 and 20 define vertical yarn slots 21 and 22 at respective ends. A cover element 23 may be snapped over the top of the housing. The housing is divided into three transverse longitudinally spaced compartments 24, 25 and 26 which contain stacked rotary members in the form of cylindrical rollers 27 carried therein. The rollers 27 are mounted transversely across the yarn passageway 16 and the housing opens into the longitudinal yarn passageway 16.

Figure 2:
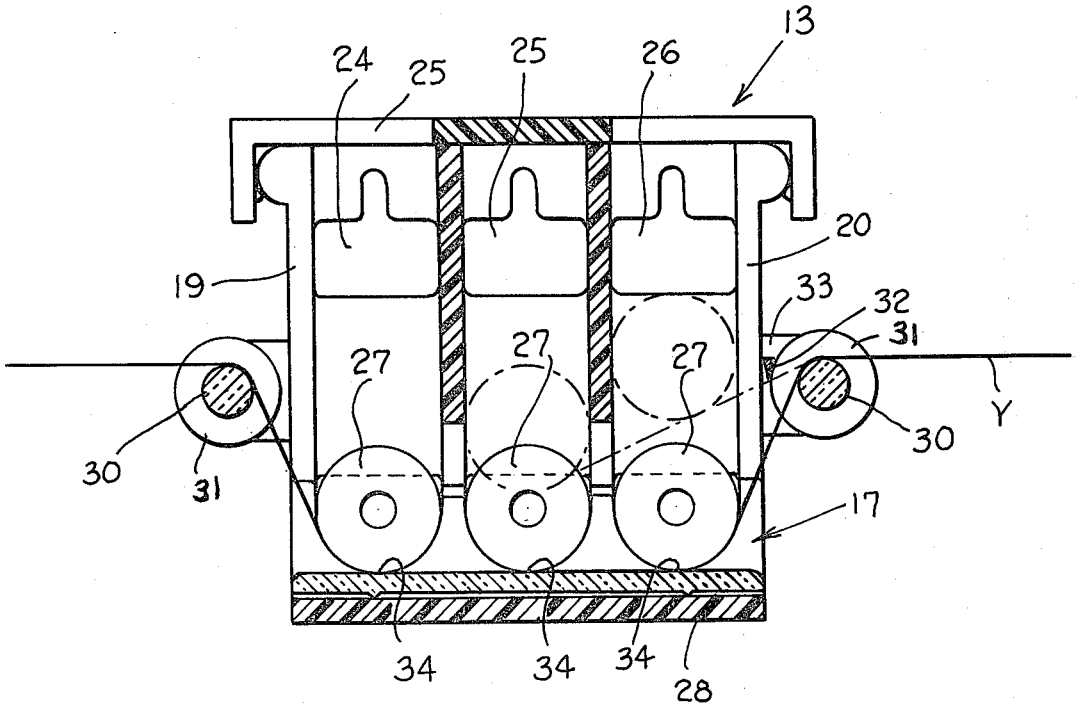
FIG. 2 illustrates a yarn path in the device of FIG. 1 utilizing externally positioned arcuate surfaces facilitating raising and lowering of the stacks of rollers as a result of unusual tension being placed upon the yarn to vary the yarn path during tensioning.

It will be noted that suitable openings 28 are provided in the front wall 15 of the housing so that lint may be expelled from the receptacles 24, 25 and 26. The yarn Y is illustrated in FIG. 2 as passing over arcuate members 30 in order to provide shock absorbing means for accommodating sudden variations in tension in the yarn Y as may vary the yarn path by lifting the rollers or permitting the rollers to float to compensate for incoming and outgoing tension variation. The arcuate members 30 have flanges 31 on each side to retain the yarn therebetween in the yarn passageway during tensioning. It will be noted especially in FIG. 2 that the yarn may be raised to the point of engagement by a blade 32 carried by a support 33 which carries the roller member 30 adjacent the exit end of the yarn tensioning device. The blade 32 thus parts the yarn in the event of excessive deviation in the yarn path as a result of the sudden exertion of tension upon the yarn Y. The ceramic yarn tensioning member has a convex raised portion 34 carried centrally of the longitudinal yarn passageway and centrally transversely of the axis of the rollers to provide a support for the yarn for insuring positive engagement thereof by the rollers 27 for tensioning purposes.

Figure 3:
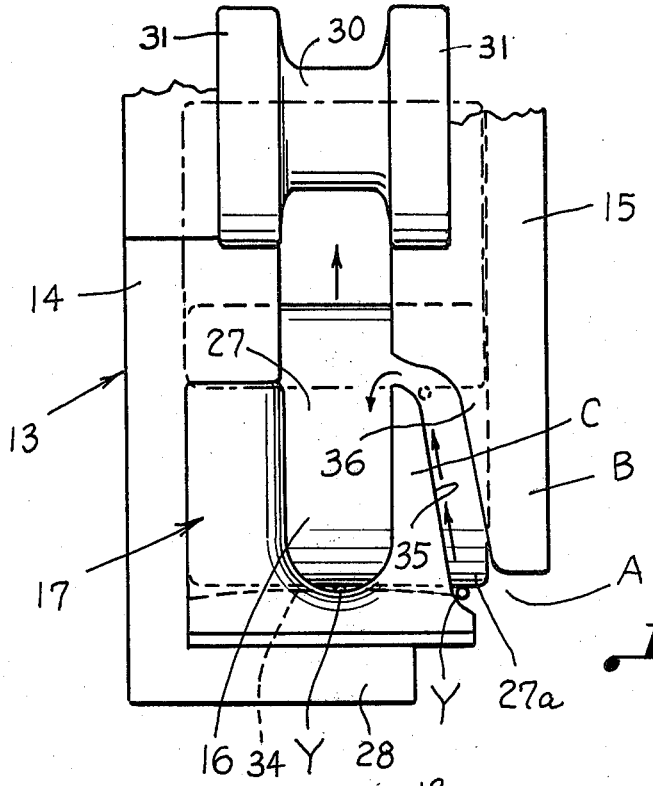
FIG. 3 is an end elevation illustrating the positioning of yarn for raising of one end of the rollers thus threading yarn into a device constructed in accordance with the invention.
Figure 4:
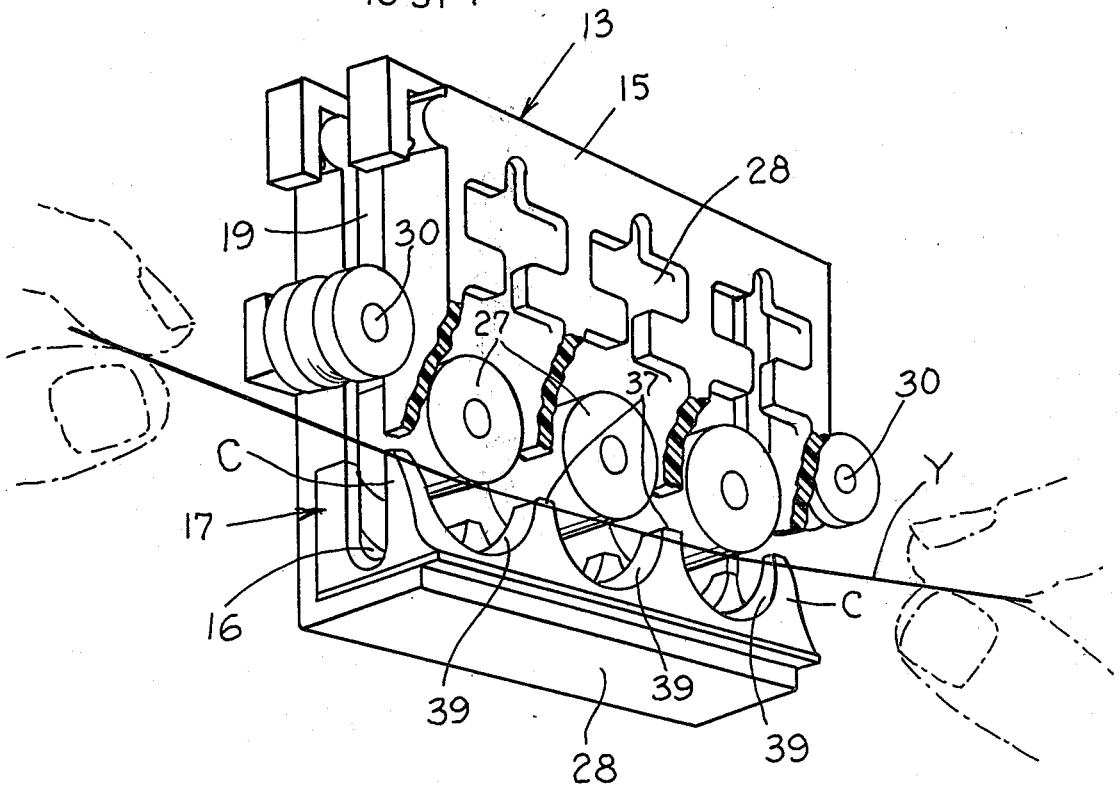
FIG. 4 is a perspective view looking from the lower portion of FIG. 1 further illustrating the raising of the rotatable cylinders during threading of the yarn into the longitudinal yarn channel by a single motion wherein the yarn enters the lateral passageway hereof.

Referring now more particularly to FIGS. 3 and 4, it will be noted that an end portion 27*a* of each of the lowermost cylinders is cantilevered extending beyond the ceramic member to form an entrance portion for the lateral passageway A to accommodate reception of the yarn beneath the cylinders. The yarn may then pass upwardly within the slot A between the depending member B and the element C which forms one side of the yarn passageway 16. The element C has an inwardly and upwardly tapering surface 35 for guiding the yarn thereover and confining same as within a trap in the yarn passageway during yarn tensioning. A transverse member 36 is carried adjacent the entrance and exit ends of the yarn tensioning device in order to confine the rollers therein. It is important to note however, that the elements C extend upwardly above the center line of each of the rollers as disclosed in seated arrangement in FIG. 3 so that a wear resistant surface positions same against lateral dislodgement at all times.

It will be noted that the end members C in FIG. 4 are taller than the intermediate members having upper portions designated at 37 in FIG. 4 so that the yarn Y may be more conveniently passed thereover during threading and retained therein. It is preferred that even the intermediate elements having the upper surfaces 37 extend above the central axis of the rollers as positioned in FIG. 3. It is also important that the member B overlap the member C so as to retain the yarn and to at all times position the cylinders against excessive endwise movement. The transverse members 36 at the terminal portions of the yarn passageway also serve to position the rollers against longitudinal dislodgement. The compartments 39 are formed at spaced locations within the yarn channel forming ceramic member.

While a preferred embodiment of the invention has been described using specific terms, such description is for illustrative purposes only, and it is to be understood that changes and variations may be made without departing from the spirit or scope of the following claims.

What is claimed is:

1. A yarn tensioning device comprising:

a longitudinal housing comprised of longitudinally aligned upright receptacles providing a yarn passageway having an entrance and exit through said housing:

stacked cylindrical rollers carried transversely across said yarn passageway;

said rollers being carried in stacked relation in said receptacles for engagement with said yarn at longitudinally spaced positions along said yarn passageway for rotating said rollers;

said rollers being carried in stacked relation in said receptacles so as to be freely raisable when excessive yarn tension is applied;

a vertical slot in said housing extending upwardly from said passageway and in alignment therewith;

at least one yarn guiding means carried by said housing spaced externally of said vertical slot and transversely disposed thereacross above a lowermost roller in said receptacles permitting yarn to be threaded through said slot and over said yarn guiding means;

a transverse cutting means carried between said yarn guiding means and said rollers across said slot below said yarn guiding means for severing said yarn when tensioned sufficiently to raise said rollers so as to bring said yarn into engagement with said cutting means;

whereby yarn passes beneath said rollers and over said arcuate yarn guide means for turning said rollers, and so that excessive variations in yarn tension are compensated by raising of rollers which maintain substantially even tension until the rollers are lowered or become sufficiently elevated because of the application of additional tension to result in severing of the yarn by the cutting means.

2. The structure set forth in claim 1 wherein said cutting means includes a fixed mounting for a blade.

* * * * *